US008482467B2

(12) United States Patent
Jarvis et al.

(10) Patent No.: US 8,482,467 B2
(45) Date of Patent: Jul. 9, 2013

(54) CUSTOMIZABLE ANTENNA STRUCTURES FOR ADJUSTING ANTENNA PERFORMANCE IN ELECTRONIC DEVICES

(75) Inventors: Daniel W. Jarvis, Sunnyvale, CA (US); Dean F. Darnell, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 400 days.

(21) Appl. No.: 12/823,929

(22) Filed: Jun. 25, 2010

(65) Prior Publication Data

US 2011/0316751 A1 Dec. 29, 2011

(51) Int. Cl.
*H01Q 1/24* (2006.01)
*H01Q 1/38* (2006.01)

(52) U.S. Cl.
USPC ..... 343/702; 343/700 MS

(58) Field of Classification Search
CPC ..... H01Q 1/243
USPC ..... 343/702, 700 MS
See application file for complete search history.

(56) References Cited

U.S. PATENT DOCUMENTS

| | | | | |
|---|---|---|---|---|
| 4,617,571 | A | 10/1986 | Choquer et al. | |
| 6,014,113 | A | 1/2000 | Orchard et al. | |
| 6,812,898 | B2 | 11/2004 | Doub et al. | |
| 6,897,814 | B2 * | 5/2005 | Iwai et al. | 343/702 |
| 7,132,987 | B1 | 11/2006 | Olsson et al. | |
| 7,612,725 | B2 * | 11/2009 | Hill et al. | 343/702 |
| 7,671,804 | B2 * | 3/2010 | Zhang et al. | 343/700 MS |
| 7,876,274 | B2 * | 1/2011 | Hobson et al. | 343/702 |
| 7,889,139 | B2 | 2/2011 | Hobson et al. | |
| 7,936,307 | B2 * | 5/2011 | Pang et al. | 343/702 |
| 8,169,373 | B2 * | 5/2012 | Schlub et al. | 343/702 |
| 2008/0055164 | A1 * | 3/2008 | Zhang et al. | 343/702 |
| 2009/0179811 | A1 * | 7/2009 | Chou | 343/787 |
| 2009/0256758 | A1 | 10/2009 | Schlub et al. | |
| 2009/0256759 | A1 | 10/2009 | Hill et al. | |
| 2010/0060421 | A1 | 3/2010 | Chang et al. | |
| 2010/0060529 | A1 * | 3/2010 | Schlub et al. | 343/702 |

(Continued)

FOREIGN PATENT DOCUMENTS

| | | |
|---|---|---|
| DE | 20314836 | 11/2003 |
| DE | 10353104 | 6/2005 |

(Continued)

OTHER PUBLICATIONS

Mow et al., U.S. Appl. No. 12/831,180, filed Jul. 6, 2010.

(Continued)

*Primary Examiner* — Vibol Tan
(74) *Attorney, Agent, or Firm* — Treyz Law Group; G. Victor Treyz; Michael H. Lyons

(57) ABSTRACT

Custom antenna structures may be used to compensate for manufacturing variations in electronic device antennas. An electronic device antenna may have an antenna feed and conductive structures such as portions of a peripheral conductive electronic device housing member and other conductive antenna structures. The custom antenna structures compensate for manufacturing variations in the conductive antenna structures that could potentially lead to undesired variations in antenna performance. The custom antenna structures may make customized alterations to antenna feed structures or conductive paths within an antenna. An antenna may be formed from a conductive housing member that surrounds an electronic device. Custom antenna structures may be interposed between an antenna feed terminal and the conductive housing member to adjust the effective location of the antenna feed. Custom antenna structures may include springs and custom paths on dielectric supports.

20 Claims, 18 Drawing Sheets

U.S. PATENT DOCUMENTS

| | | | | |
|---|---|---|---|---|
| 2010/0123632 | A1 | 5/2010 | Hill et al. | |
| 2011/0063779 | A1 | 3/2011 | Ochi et al. | |
| 2012/0162033 | A1* | 6/2012 | Togashi | 343/720 |

FOREIGN PATENT DOCUMENTS

| | | |
|---|---|---|
| GB | 2384367 | 7/2003 |
| KR | 2004108759 | 12/2004 |
| WO | 2008010149 | 1/2008 |

OTHER PUBLICATIONS

Schlub et al., U.S. Appl. No. 12/759,243, filed Apr. 13, 2010.
Chiang et a., U.S. Appl. No. 12/401,599, filed Mar. 10, 2009.
Pascolini et al., U.S. Appl. No. 12/630,756, filed Dec. 3, 2009.
Nickel et al., U.S. Appl. No. 12/752,966, filed Apr. 1, 2010.
Caballero, et al., U.S. Appl. No. 12/941,010, filed Nov. 5, 2010.
Lee et al. "A Compact and Low-Profile Tunable Loop Antenna Integrated With Inductors", IEEE Antennas and Wireless Propagation Letters, vol. 7, 2008 pp. 621-624.
Nanbo Jin et al., U.S. Appl. No. 13/041,905, filed Mar. 7, 2011.
Menzel et al., "A Microstrip Patch Antenna with Coplanar Feed Line" IEEE Microwave and Guided Wave Letters, vol. 1, No. 11, Nov. 1991, pp. 340-342.
Terada et al., "Circularly Polarized Tunable Microstrip Patch Antenna Using an Adjustable Air Gap", Proceedings of ISAP2005, Seoul, Korea pp. 977-980.
Nanbo Jin et al., U.S. Appl. No. 13/041,934, filed Mar. 7, 2011.

* cited by examiner

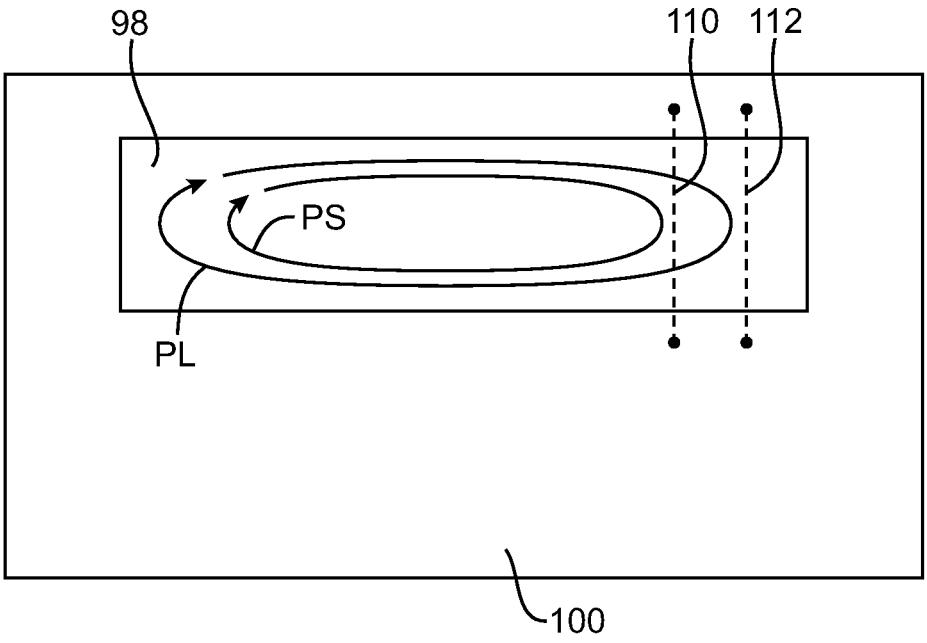
FIG. 6
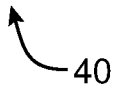

CUSTOMIZABLE ANTENNA STRUCTURES FOR ADJUSTING ANTENNA PERFORMANCE IN ELECTRONIC DEVICES

BACKGROUND

This relates generally to electronic devices, and more particularly, to electronic devices that have antennas.

Electronic devices such as computers and handheld electronic devices are often provided with wireless communications capabilities. For example, electronic devices may use long-range wireless communications circuitry such as cellular telephone circuitry to communicate using cellular telephone bands. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz.

Antenna performance can be critical to proper device operation. Antennas that are inefficient or that are not tuned properly may result in dropped calls, low data rates, and other performance issues. There are limits, however, to how accurately conventional antenna structures can be manufactured.

Many manufacturing variations are difficult or impossible to avoid. For example, variations may arise in the size and shape of printed circuit board traces, variations may arise in the density and dielectric constant associated with printed circuit board substrates and plastic parts, and conductive structures such as metal housing parts and other metal pieces may be difficult or impossible to construct with completely repeatable dimensions. Some parts are too expensive to manufacture with precise tolerances and other parts may need to be obtained from multiple vendors, each of which may use a different manufacturing process to produce its parts.

Manufacturing variations such as these may result in undesirable variations in antenna performance. An antenna may, for example, exhibit an antenna resonance peak at a first frequency when assembled from a first set of parts, while exhibiting an antenna resonance peak at a second frequency when assembled from a second set of parts. If the resonance frequency of an antenna is significantly different than the desired resonance frequency for the antenna, a device may need to be scrapped or reworked.

It would therefore be desirable to provide a way in which to address manufacturability issues such as these so as to make antenna designs more amenable to reliable mass production.

SUMMARY

An electronic device may be provided with antennas. An electronic device may have a display and a peripheral conductive member that surrounds the display. The peripheral conductive member may form a display bezel or housing sidewalls.

The peripheral conductive member and other conductive structures may be used in forming an antenna in the electronic device. An antenna feed having positive and ground antenna feed terminals may be used to feed the antenna.

During manufacturing operations, parts for an electronic device may be constructed using different manufacturing processes and may otherwise be subject to manufacturing variations. If care is not taken, these manufacturing variations can lead to performance variations when the parts are assembled into an antenna.

To compensate for manufacturing variations, custom antenna structures may be included in the antenna of each electronic device. If, for example, a device antenna includes parts that would cause the antenna to exhibit resonance peaks that are lower in frequency than desired, custom antenna structures may be included in the device antenna to alter the performance of the antenna and ensure that the resonance peaks are shifted higher in frequency to their desired position. If a device antenna includes parts that would cause the antenna to exhibit resonance peaks that are higher in frequency than desired, custom antenna structures may be included in the device antenna to alter the performance of the antenna and ensure that the resonance peaks are shifted lower in frequency to their desired position.

The customized antenna structures may include custom metal structures such as springs with customized shapes, custom patterns of traces on dielectric support structures, or other custom structures. With one suitable arrangement, the customized antenna structures may include a dielectric support structure on which a custom conductive path is formed. The path may follow different routes on different custom structures. Springs or other conductive members may be used to form electrical connections to opposing ends of the custom conductive path.

Further features of the invention, its nature and various advantages will be more apparent from the accompanying drawings and the following detailed description of the preferred embodiments.

BRIEF DESCRIPTION OF THE DRAWINGS

FIG. 6 is a top view of a slot antenna showing how the position of conductive antenna structures in the slot antenna can be varied to adjust slot size and thereby adjust antenna performance to compensate for manufacturing variations in accordance with an embodiment of the present invention.

DETAILED DESCRIPTION

Figure 1:
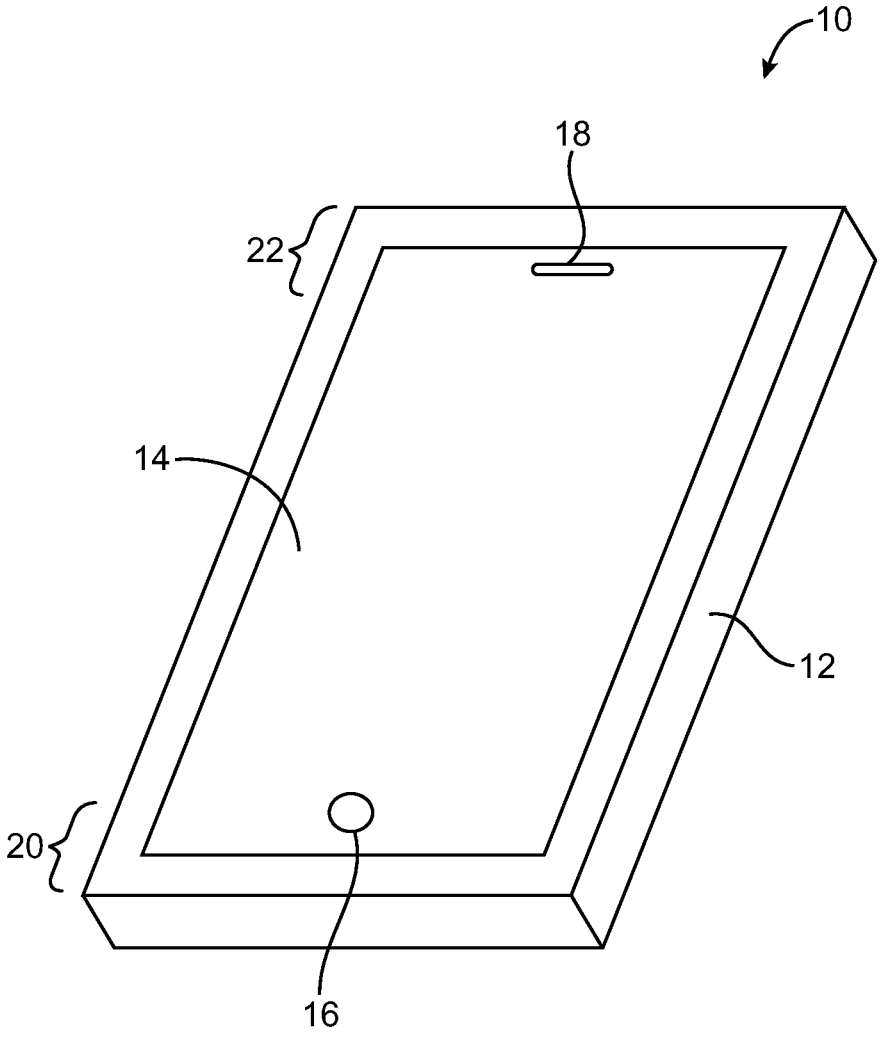
FIG. 1 is a perspective view of an illustrative electronic device with wireless communications circuitry in accordance with an embodiment of the present invention.

An illustrative electronic device of the type that may be provided with custom antenna structures to compensate or manufacturing variations is shown in FIG. 1. Electronic devices such as illustrative electronic device 10 of FIG. 1 may be laptop computers, tablet computers, cellular telephones, media players, other handheld and portable electronic devices, smaller devices such as wrist-watch devices, pendant devices, headphone and earpiece devices, other wearable and miniature devices, or other electronic equipment.

As shown in FIG. 1, device 10 includes housing 12. Housing 12, which is sometimes referred to as a case, may be formed of materials such as plastic, glass, ceramics, carbon-fiber composites and other composites, metal, other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electronic ink elements, liquid crystal display (LCD) components, or other suitable image pixel structures. A cover layer such as a cover glass member may cover the surface of display 14. Buttons such as button 16 may pass through openings in the cover glass. Openings may also be formed in the cover glass of display 14 to form a speaker port such as speaker port 18. Openings in housing 12 may be used to form input-output ports, microphone ports, speaker ports, button openings, etc.

Wireless communications circuitry in device 10 may be used to form remote and local wireless links. One or more antennas may be used during wireless communications. Single band and multiband antennas may be used. For example, a single band antenna may be used to handle local area network communications at 2.4 GHz (as an example). As another example, a multiband antenna may be used to handle cellular telephone communications in multiple cellular telephone bands. Antennas may also be used to receive global positioning system (GPS) signals at 1575 MHz in addition to cellular telephone signals and/or local area network signals. Other types of communications links may also be supported using single-band and multiband antennas.

Antennas may be located at any suitable locations in device 10. For example, one antenna may be located in an upper region such as region 22 and another antenna may be located in a lower region such as region 20. If desired, antennas may be located along device edges, in the center of a rear planar housing portion, in device corners, etc.

Antennas in device 10 may be used to support any communications bands of interest. For example, device 10 may include antenna structures for supporting local area network communications (e.g., IEEE 802.11 communications at 2.4 GHz and 5 GHz for wireless local area networks), signals at 2.4 GHz such as Bluetooth® signals, voice and data cellular telephone communications (e.g., cellular signals in bands at frequencies such as 850 MHz, 900 MHz, 1800 MHz, 1900 MHz, 2100 MHz, etc.), global positioning system (GPS) communications at 1575 MHz, signals at 60 GHz (e.g., for short-range links), etc.

Figure 2:
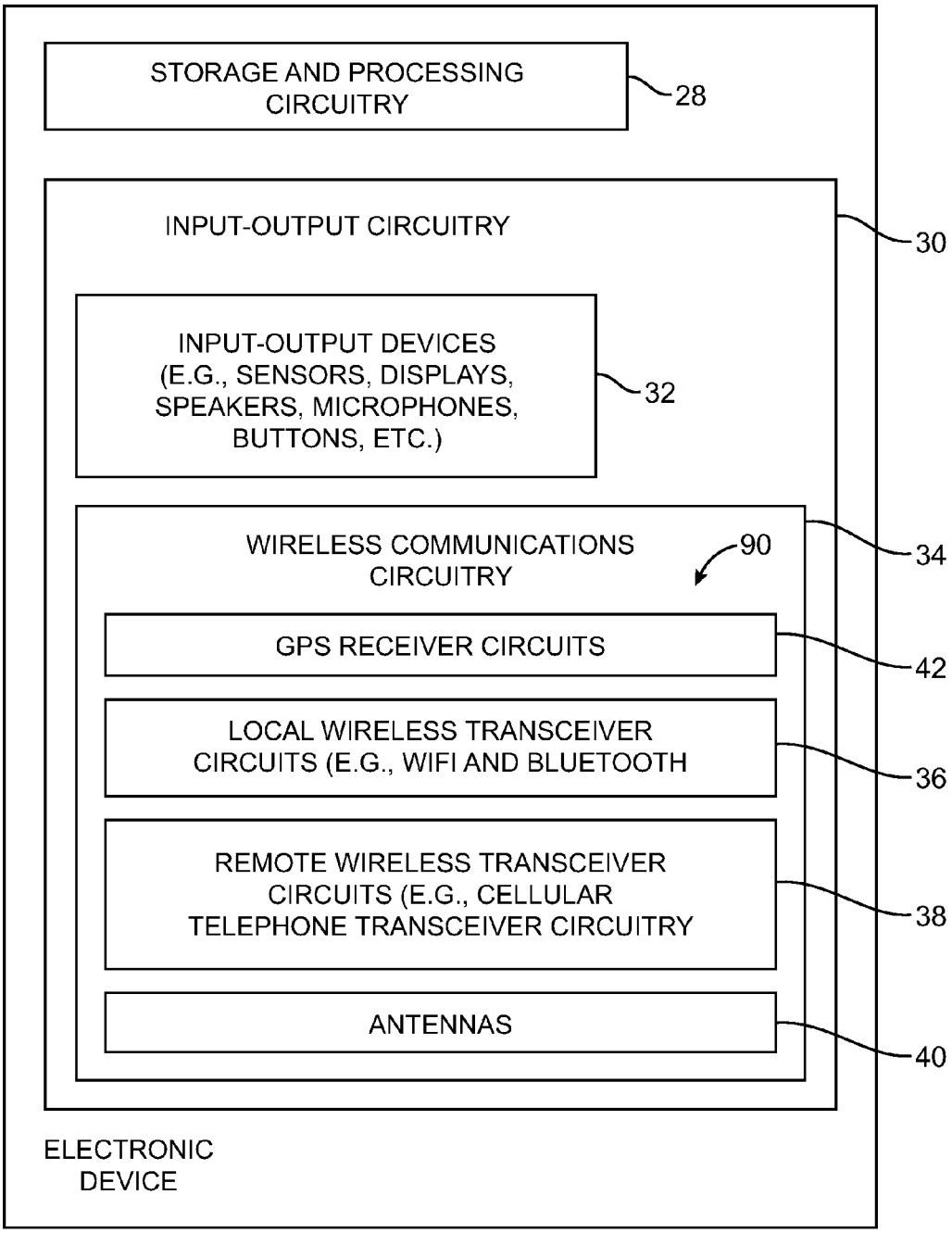
FIG. 2 is a schematic diagram of an illustrative electronic device with wireless communications circuitry in accordance with an embodiment of the present invention.

A schematic diagram showing illustrative components that may be used in device 10 of FIG. 1 is shown in FIG. 2. As shown in FIG. 2, device 10 may include storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands at 850 MHz, 900 MHz, 1800 MHz, 1900 MHz, and 2100 MHz (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structure, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
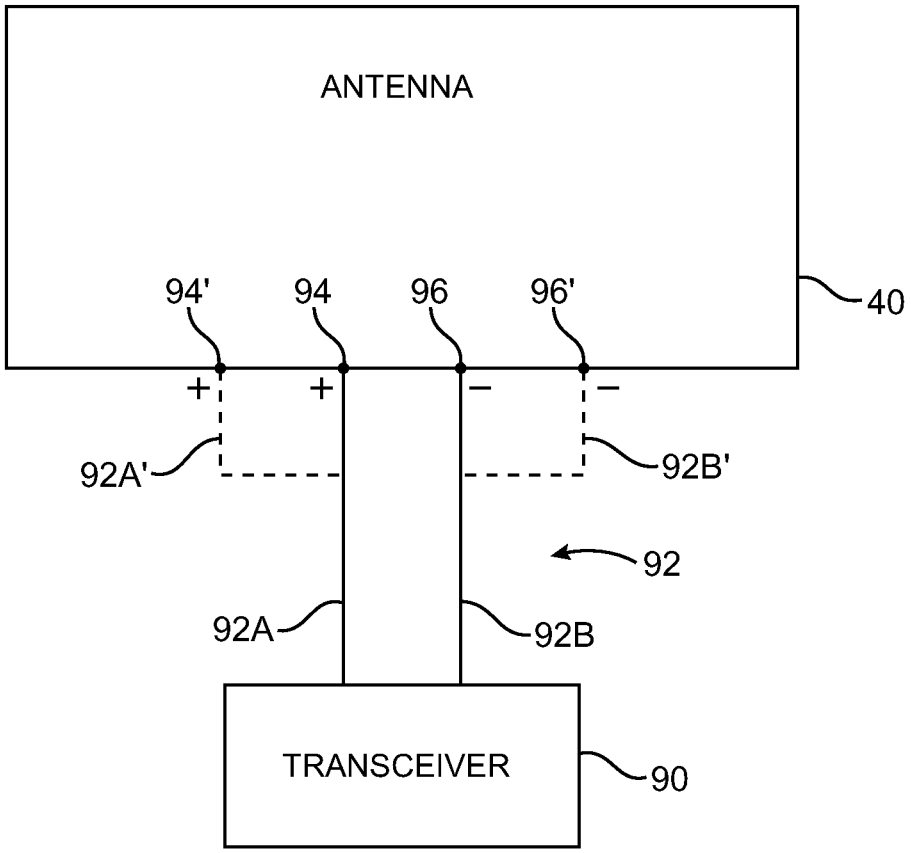
FIG. 3 is circuit diagram of illustrative wireless communications circuitry having a radio-frequency transceiver coupled to an antenna by a transmission line in accordance with an embodiment of the present invention.

As shown in FIG. 3, transceiver circuitry 90 may be coupled to one or more antennas such as antenna 40 using transmission line structures such as transmission line 92. Transmission line 92 may have positive signal path 92A and ground signal path 92B. Paths 92A and 92B may be formed on rigid and flexible printed circuit boards, may be formed on dielectric support structures such as plastic, glass, and ceramic members, may be formed as part of a cable, etc. Transmission line 92 may be formed using one or more microstrip transmission lines, stripline transmission lines, edge coupled microstrip transmission lines, edge coupled stripline transmission lines, coaxial cables, or other suitable transmission line structures.

Transmission line 92 may be coupled to an antenna feed formed from antenna feed terminals such as positive antenna feed terminal 94 and ground antenna feed terminal 96. As shown in FIG. 3, changes may be made to transmission line conductors 92A and 92B (e.g., to change path 92A so that it uses path 92A' to couple to positive antenna feed terminal 94' rather than positive antenna feed terminal 94 and to change path 92B so that it follows path 92B' to couple to ground antenna feed terminal 96' rather than ground antenna feed terminal 96). Changes to the structure of the antenna feed for antenna 40 (e.g., the positions of the positive and/or ground antenna feed terminals among the structures of the antenna) affect antenna performance. In particular, the frequency response of the antenna (characterized, as an example, by a standing wave ratio plot as a function of operating frequency) will exhibit changes at various operating frequencies. In some situations, the antenna will become more responsive at a given frequency and less responsive at another frequency. Feed alterations may also create global antenna efficiency increases or global antenna efficiency decreases.

Figure 4:
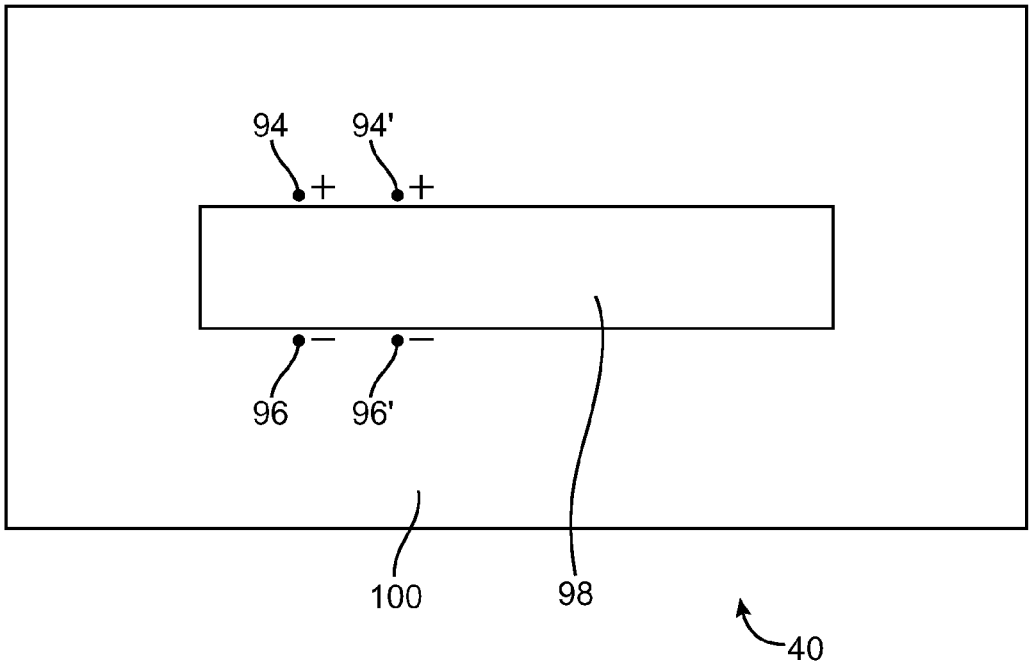
FIG. 4 is a top view of a slot antenna showing how the position of antenna feed terminals may be varied to adjust antenna performance and thereby compensate for manufacturing variations in accordance with an embodiment of the present invention.

A diagram showing illustrative feed positions that may be used in a slot antenna in device 10 is shown in FIG. 4. As shown in FIG. 4, slot antenna 40 may be formed from conductive structures 100 that form slot 98. Slot 98 may be formed from a closed or open rectangular opening in structures 100 or may have other opening shapes. Slot 98 is generally devoid of conductive materials. In a typical arrangement, some or all of slot 98 may be filled with air and some or all of slot 98 may be filled with other dielectric materials (e.g., electronic components that are mostly formed from plastic, plastic support structures, printed circuit board substrates such as fiberglass-filled epoxy substrates, flex circuits formed from sheets of polymer such as polyimide, etc.).

In antennas such as slot antenna 40 of FIG. 4, the position of the antenna feed tends to affect antenna performance. For example, antenna 40 of FIG. 4 will typically exhibit a different frequency response when fed using an antenna feed formed from positive antenna feed terminal 94 and ground antenna feed terminal 96 than when fed using positive antenna feed terminal 94' and ground antenna feed terminal 96'.

Figure 5:
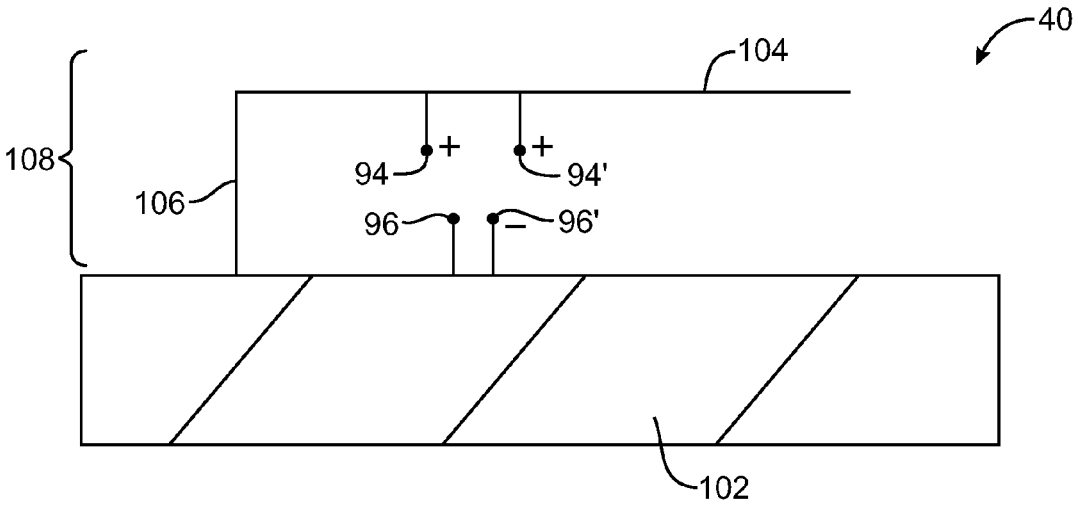
FIG. 5 is a diagram of an inverted-F antenna showing how the position of antenna feed terminals may be varied to adjust antenna performance and thereby compensate for manufacturing variations in accordance with an embodiment of the present invention.

FIG. 5 is a diagram showing illustrative feed positions that may be used in an inverted-F antenna in device 10. As shown in FIG. 5, inverted-F antenna 40 may be formed from antenna ground 102 and antenna resonating element 108. Antenna ground 102 and antenna resonating element 108 may be formed from one or more conductive structures in device 10 (e.g., conductive housing structures, printed circuit board traces, wires, strips of metal, etc.). Antenna resonating element 108 may have a main arm such as antenna resonating element arm 104. Short circuit branch 106 may be used to create a short circuit path between arm 104 and ground 102.

The position of the antenna feed within antenna 40 of FIG. 5 will generally affect antenna performance. In particular, movements of the antenna feed to different positions along arm 104 will result in different antenna impedances and therefore different frequency responses for the antenna. For example, antenna 40 will typically exhibit a different frequency response when fed using antenna feed terminals 94 and 96 rather than antenna feed terminals 94' and 96'.

The configuration of the conductive structures in antenna 40 such as antenna resonating element structures (e.g., the structures of antenna resonating element 108 of FIG. 5) and antenna ground structures (e.g., antenna ground conductor structures 102 of FIG. 5) also affects antenna performance. For example, changes to the length of antenna resonating element arm 104 of FIG. 5, changes to the position of short circuit branch 106 of FIG. 5, changes to the size and shape of ground 102 of FIG. 5, and changes to the slot antenna structures of FIG. 4 will affect the frequency response of the antenna.

FIG. 6 illustrates how a slot antenna may be affected by the configuration of conductive elements that overlap the slot. As shown in FIG. 6, slot antenna 40 of FIG. 6 has a slot opening 98 in conductive structure 100. Two illustrative configurations are illustrated in FIG. 6. In the first configuration, conductive element 110 bridges the end of slot 98. In the second configuration, conductive element 112 bridges the end of slot 98.

The length of the perimeter of opening 98 affects the position of the resonance peaks of antenna 100 (e.g., there is typically a resonance peak when radio-frequency signals have a wavelength equal to the length of the perimeter). When element 112 is present in slot 98, the size of the slot is somewhat truncated and exhibits long perimeter PL. When element 110 is present across slot 98, the size of the slot is further truncated and exhibits short perimeter PS. Because PS is shorter than PL, antenna 40 will tend to exhibit a resonance with a higher frequency when structure 110 is present than when structure 112 is present.

Figure 7:
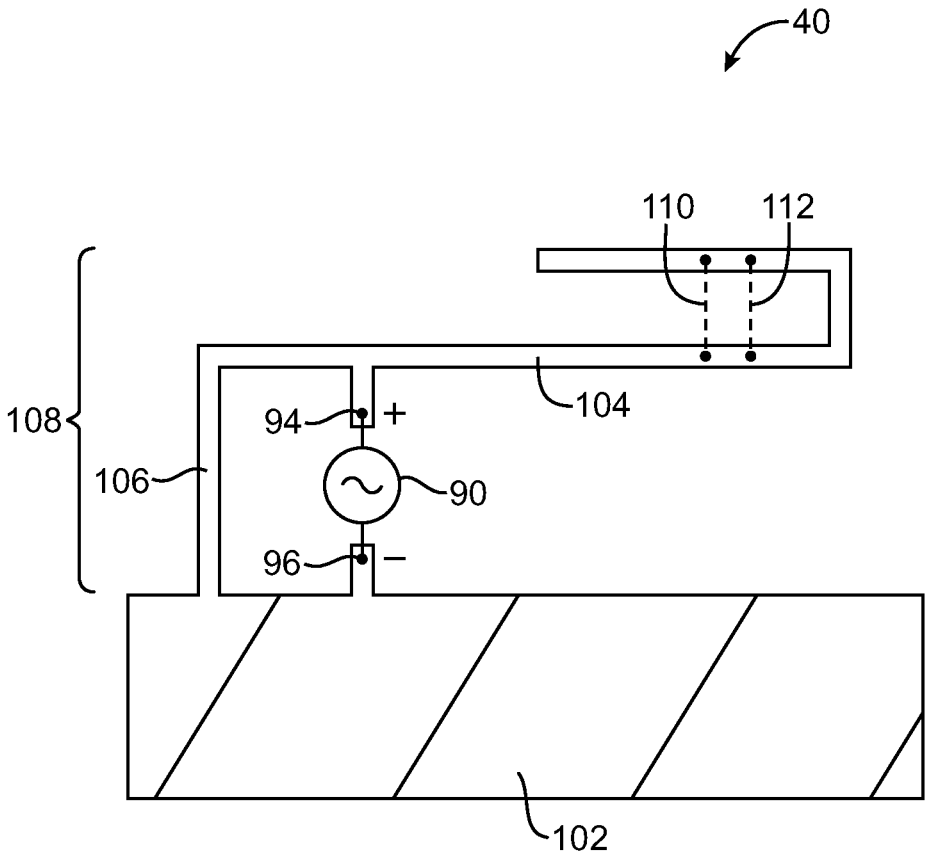
FIG. 7 is a diagram of an inverted-F antenna showing how the position of conductive antenna structures in the inverted-F antenna can be varied to adjust the size of an antenna resonating element structure and thereby adjust antenna performance to compensate for manufacturing variations in accordance with an embodiment of the present invention.

The size and shape of the conductive structures in other types of antennas such as inverted-F antenna 30 of FIG. 7 affect the performance of those antennas. As shown in FIG. 7, antenna resonating element arm 104 in antenna resonating element 108 of antenna 40 may be have a conductive structure that can be placed in the position of conductive structure 110 or the position of conductive structure 112. The position of this conductive structure alters the effective length of antenna resonating element arm 104 and thereby alters the position of the antenna's resonant peaks.

As the examples of FIGS. 3-7 demonstrate, alterations to the positions of antenna feed terminals and the conductive materials that form an antenna change the frequency response of the antenna. Due to manufacturing variations, antenna feed positions and conductive antenna material shapes and sizes may be inadvertently altered, leading to variations in an antenna's frequency response relative to a desired nominal frequency response. These unavoidable manufacturing variations may arise due to the limits of manufacturing tolerances (e.g., the limited ability to machine metal parts within certain tolerances, the limited ability to manufacture printed circuit board traces with desired conductivities and line widths, trace thickness, etc.). To compensate for undesired manufacturing variations such as these, device 10 may include custom antenna structures.

In a typical manufacturing process, different batches of electronic device 10 (e.g., batches of device 10 formed form parts from different vendors or parts made from different manufacturing processes) can be individually characterized. One the antenna performance for a given batch of devices has been ascertained, any needed compensating adjustments can be made by constructing and installing customized antenna structures within the antenna portion of each device.

As an example, a first custom structure may be constructed with a first layout to ensure that the performance of a first batch of electronic devices is performing as expected, whereas a second custom structure may be provided with a second layout to ensure that the performance of a second batch of electronic devices is performing as expected. With this type of arrangement, the antenna performances for the first and second batches of devices can be adjusted during manufacturing by virtue of inclusion of the custom structures, so that identical or nearly identical performance between the first and second batches of devices is obtained.

Figure 8:
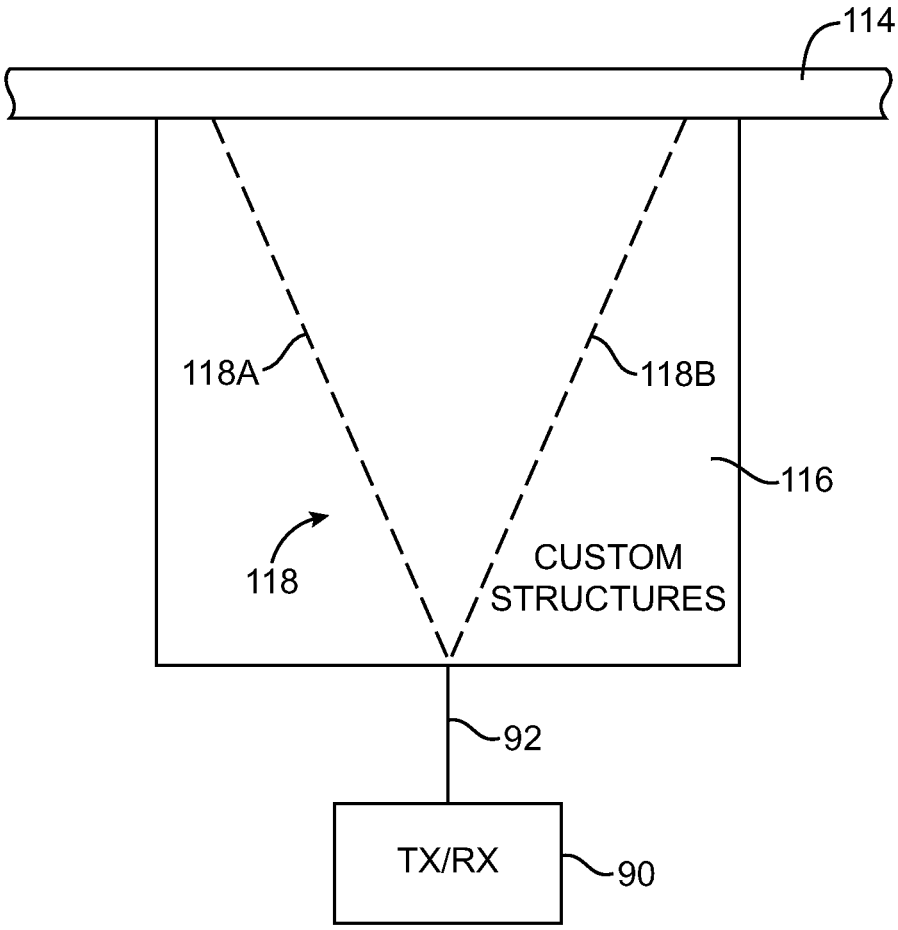
FIG. 8 is a diagram of antenna structures in an electronic device showing how a custom antenna structure may be used to adjust an antenna to compensate for manufacturing variations in accordance with an embodiment of the present invention.

FIG. 8 shows how antenna 40 may include conductive structures such as conductive structures 114 and custom structures such as custom structures 116. Conductive structures 114 may be antenna resonating element structures, antenna ground structures, etc. With one suitable arrangement, conductive structures 114 may be conductive housing structures (e.g., conductive portions of housing 12) and/or may be traces on printed circuit boards within electronic device 10. Custom structures 116 may be interposed between transmission line 92 and conductive structures 114. Transceiver circuitry 90 may be coupled to transmission line 92.

As shown in FIG. 8, custom structures 116 may include signal paths such as signal path 118. Signal path 118 may include positive and ground structures (e.g., to form transmission structures) or may contain only a single signal line (e.g., to couple part of a transmission line to an antenna structure, to couple respective antenna structures together such as two parts of an antenna resonating element, to connect two parts of a ground plane, etc.). Signal path 118 may be customized during manufacturing operations. For example, custom structures 116 may be manufactured so that a conductive line or other path takes the route illustrated by path 118A of FIG. 8 or may be manufactured so that a conductive line or other path takes the route illustrated by path 118B of FIG. 8. Some electronic devices may receive custom structures 116 in which path 118 has been configured to follow route 118A, whereas other electronic devices may receive custom structures 116 in which path 118 has been configured to follow route 118B. By providing different electronic devices (each of which includes an antenna of the same nominal design) with appropriate customized antenna structures, performance variations can be compensated and performance across devices can be equalized.

The custom antenna structures may be formed from fixed (non-adjustable) structures that are amenable to mass production. Custom structures 116 may, for example, be implemented using springs, clips, wires, brackets, machined metal parts, conductive traces such as metal traces formed on dielectric substrates such as plastic members, printed circuit board substrates, layers of polymer such as polyimide flex circuit sheets, combinations of these conductive structures, conductive elastomeric materials, spring-loaded pins, screws, interlocking metal engagement structures, other conductive structures, or any combination of these structures. Custom structures 116 may be mass produced in a fixed configuration (once an appropriate configuration for custom structures 116 been determined) and the mass produced custom structures may be included in large batches of devices 10 as part of a production line manufacturing process (e.g. a process involving the manufacture of thousands or millions of units).

Figure 9:
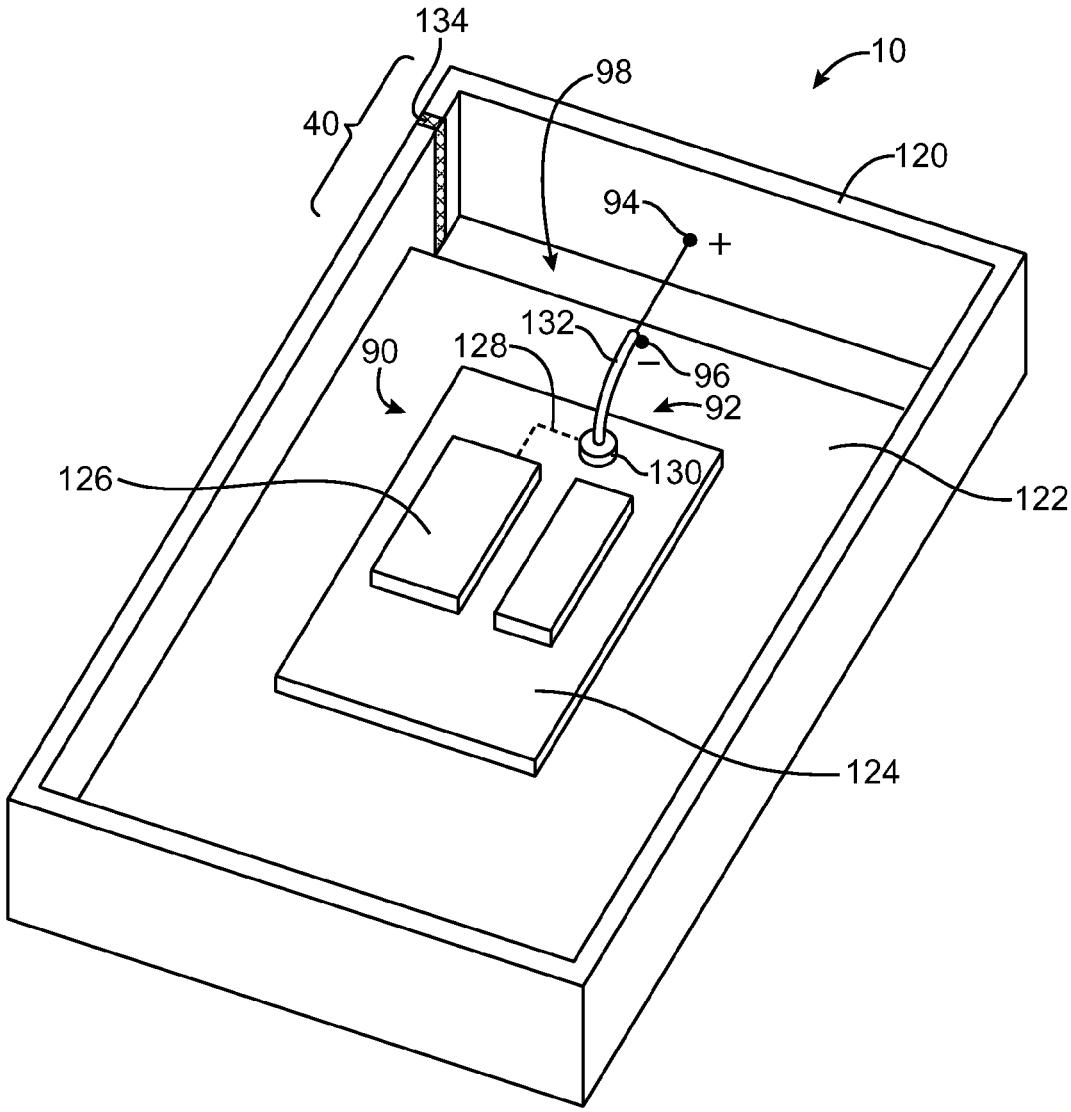
FIG. 9 is a perspective interior view of an illustrative electronic device of the type that may be provided with custom antenna structures to adjust antenna performance and thereby compensate for manufacturing variations in accordance with an embodiment of the present invention.

An illustrative arrangement that may be used for electronic device 10 of FIG. 1 is shown in FIG. 9. In the configuration of FIG. 9, display 14 has been removed so that the interior components of device 10 are visible. Antenna 40 may be formed from conductive structures such as conductive housing member 120 and conductive housing member 122. Conductive housing member 122 may be a metal plate or other conductive support structure and may form an exterior housing wall or interior support frame for device 10. Conductive housing member 120 may be a bezel or trim structure that surrounds display 14 (FIG. 1) or may be a flat or curved sidewall structure (e.g., a band-shaped structure or other peripheral conductive member) that surrounds the rectangular outline (periphery) of device 10 when viewed from the front. Conductive peripheral member 120 may, for example, be formed from stainless steel or other metals.

An opening such as opening 98 may be used in forming antenna 40 (e.g., a slot antenna, a loop antenna, part of a hybrid antenna such as a hybrid planar-inverted-F antenna and slot antenna, etc.). Opening 98 may be an air-filled slot opening or a slot-shaped opening filled with air and/or solid dielectric material such as plastic, printed circuit board substrates, glass, and ceramic. Opening 98 may be formed between portions of conductive peripheral member 120 and opposing portions of conductive member 122. A dielectric-filled gap such as gap 134 (e.g., a gap filed with plastic, glass, ceramic, air, other dielectrics, or a combination of such dielectrics) can be interposed within peripheral conductive structure 120 (e.g., in the vicinity of opening 98). Gaps such as gap 134 may be used to create loop antenna structures and other suitable structures for antenna 40. Antenna 40 may also be based on a closed-slot architecture (i.e., a slot that is completely surrounded by conductor) or an open-slot architecture (i.e., a slot that has an open end) or other suitable antenna design.

Transceiver 90 may be implemented using one or more integrated circuits such as integrated circuit 126. Integrated circuit 126 and other electrical components such may be mounted on a substrate such as substrate 124. Substrate 124 may be, for example, a flex circuit or a rigid printed circuit board substrate (as examples). Transmission line 92 may be coupled between transceiver 90 and antenna 40. Transmission line 92 may include printed circuit board traces 128, radio-frequency connectors such as radio-frequency connector 130, coaxial cables such as cable 132, and other conductive structures. Custom antenna structures (e.g., structures 116 of FIG. 8) may be incorporated into device 10 to adjust the antenna feed and/or conductive antenna structures associated with antenna 40, thereby ensuring that antenna 40 performs as desired.

Figure 10:
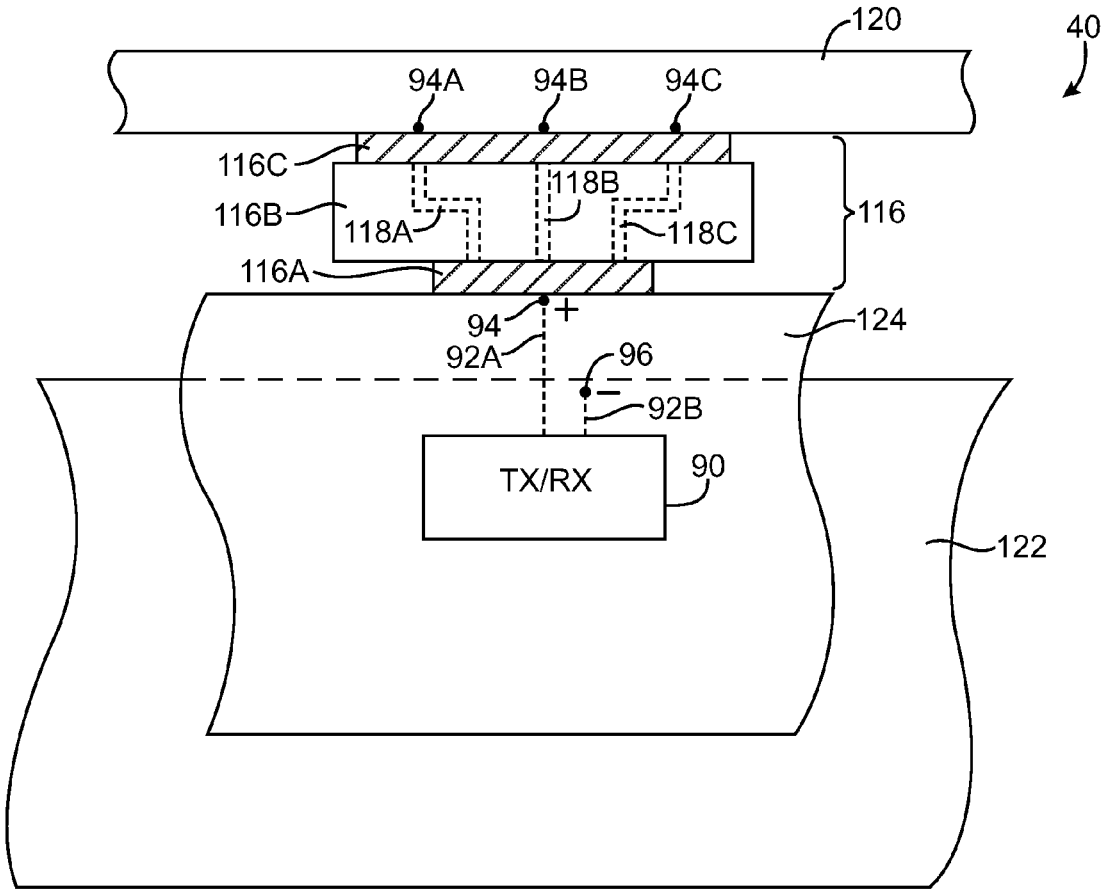
FIG. 10 is a top view of an illustrative custom antenna structure that may be used to adjust antenna performance to compensate for manufacturing variations in accordance with an embodiment of the present invention.

FIG. 10 is a top view of an illustrative arrangement for device 10 in which a custom antenna structure has been incorporated into antenna 40. As shown in FIG. 10, antenna 40 includes feed terminals 94 and 96, gap 98, and conductive structures such as conductive planar member 122 and conductive peripheral member 120 (shown in more detail in the perspective view of FIG. 9). Transmission line path 92A may be used to couple transceiver circuitry 90 to antenna feed terminal 94. Transmission line path 92B may be used to couple transceiver circuitry 90 to antenna feed terminal 96. Terminal 96 may, for example, be connected to conductive planar member 122 (e.g., a ground plane) using a conductive via through printed circuit board substrate 124.

Custom antenna structures 116 may be used to couple terminal 94 to feed terminal 94A (in configurations in which the conductive material of path 118 is configured to follow route 118A), terminal 94B (in configurations in which the conductive material of path 118 is configured to follow route 118B), or terminal 94C (in configurations in which the conductive material of path 118 is configured to follow route 118B). The decision as to which configuration to use for custom structure 116 may be made based on the results of characterization operations in which the antenna performance of representative devices 10 is measured.

As shown in FIG. 10, custom antenna structure 116 may include multiple parts such as parts 116A, 116B, and 116C. With one suitable arrangement, portions 116A and 116C of custom antenna structure 116 may be formed from engagement structures such as spring structures (e.g., spring-loaded pins or springy pieces of metal that bear against mating contacts).

Portion 116B may be formed from a dielectric support structure such as a printed circuit board structure or a piece of plastic or other dielectric material on which conductive structures have been formed (e.g., plastic with metal pads and customized metal traces for path 118 formed between the metal pads).

Custom conductive structures for path 118 may be formed by sensitizing portions of a dielectric support using light (e.g., laser light) followed by selective metal deposition (e.g., chemical vapor deposition and/or electroplating). Custom conductive structures may also be formed by blowing conductive links (e.g., by electrically blowing metal lines that serve as fuses or by using a laser to cut through unwanted metal lines). Lasers and other tools may also be used to form antifuse connections (e.g., by welding or otherwise joining two pieces of conductor together). If desired, custom conductive structures may be formed using metal stamping techniques, photolithography, metal machining and casting techniques, etc.

In the example of FIG. 10, custom antenna structures 116 are being used to alter the position of the antenna feed terminals (i.e., terminal 94) on conductive antenna structure 120. If desired, custom antenna structures such as custom antenna structures 116 of FIG. 10 may be used to alter the configuration of antenna resonating element structures (e.g., as described in connection with FIGS. 6 and 7) and/or antenna ground structures. Custom antenna structures 116 may also be used to alter both the feed for antenna 40 and the conductive resonating element and ground structures for antenna 40 or any other structures in device 10 that affect antenna performance (e.g., structures that affect transmission line loading, antenna loading, matching network impedance, etc.).

Figure 11:
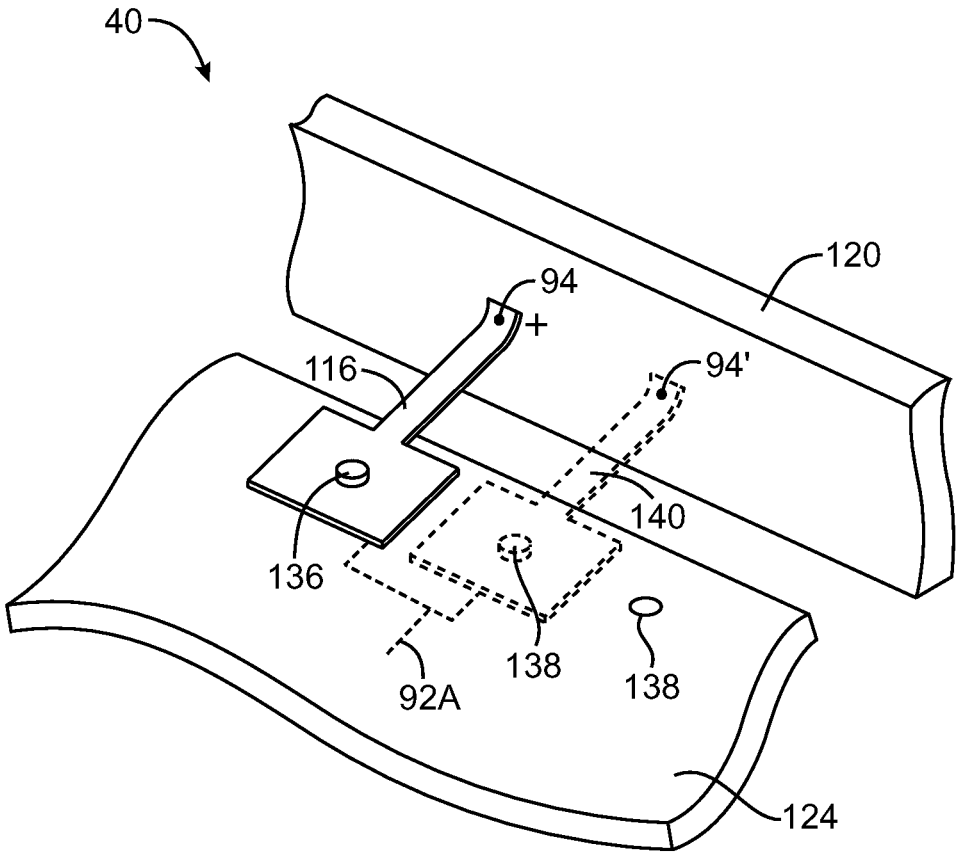
FIG. 11 is a perspective view of an illustrative custom antenna structure based on a spring that may be attached to a printed circuit board or other structure at different positions to adjust antenna performance to compensate for manufacturing variations in accordance with an embodiment of the present invention.

FIG. 11 is a perspective view of an illustrative configuration that may be used for antenna 40 in device 10 in which custom antenna structures 116 have been implemented using a spring member. As shown in FIG. 11, substrate 124 may have an array of holes 138 into which a screw such as screw 136 or other engagement structure may be received. Custom structures 116 may include a spring that can be attached to various positions along the edge of substrate 124 using screw 136. In the position shown in FIG. 11, the spring couples transmission line conductor 92A to conductive member 120 (e.g., peripheral conductive member 120 of FIG. 9) at antenna feed location 94. In the position indicated by dashed line 140, the spring couples transmission line conductor 92A to peripheral conductive member 120 at antenna feed terminal location 94' (i.e., a different custom location). If desired, solder, welds, or other fastening mechanisms may be used instead of screw 136 or in addition to screw 136 to form an electrical connection between structures 116 and transmission line 92 on substrate 124.

Figure 12:
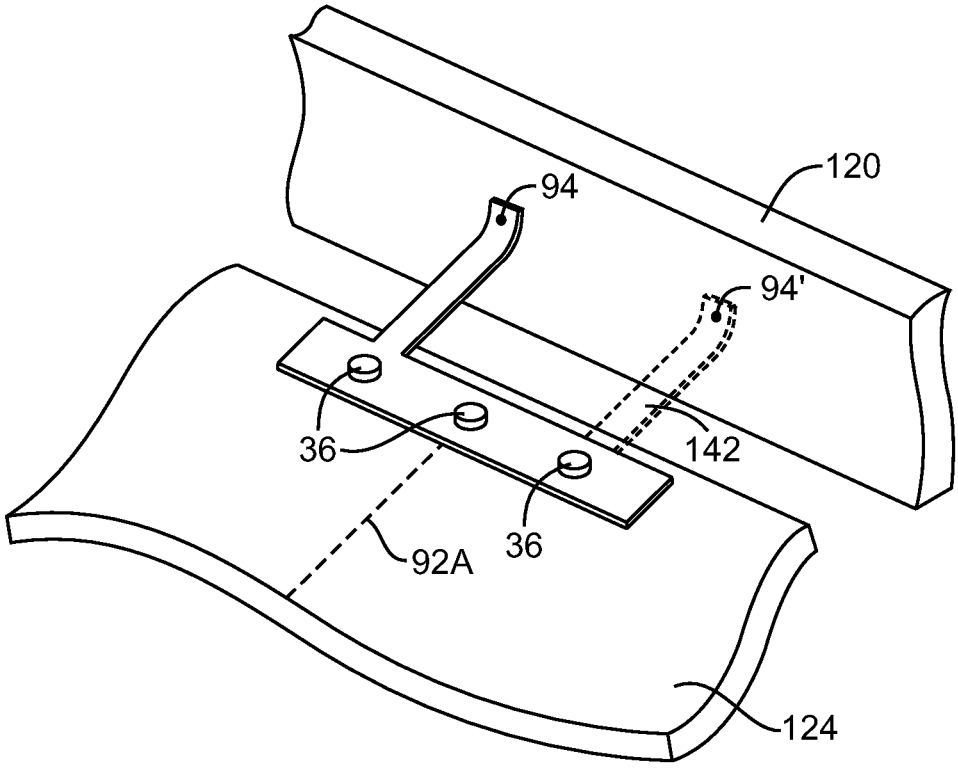
FIG. 12 is a perspective view of an illustrative customizable antenna structure based on a spring with a custom prong position that may be used to form a conductive antenna path to different portions of an antenna structure to adjust antenna performance and thereby compensate for manufacturing variations in accordance with an embodiment of the present invention.

FIG. 12 is a perspective view of an illustrative custom antenna structure configuration for antenna 40 in device 10 in which the shape of custom antenna structure 116 can be altered (e.g., to form a spring that contacts feed terminal 94 as shown in FIG. 12 or to form a spring of the type indicated by dashed lines 142 that contacts feed terminal 94'). In some devices, a custom antenna structure with one configuration may be used to compensate antenna 40 for manufacturing variations that affect antenna performance, whereas in other devices a custom antenna structure with a different configuration may be used to compensate antenna 40 for a different set of manufacturing variations.

Figure 13A:
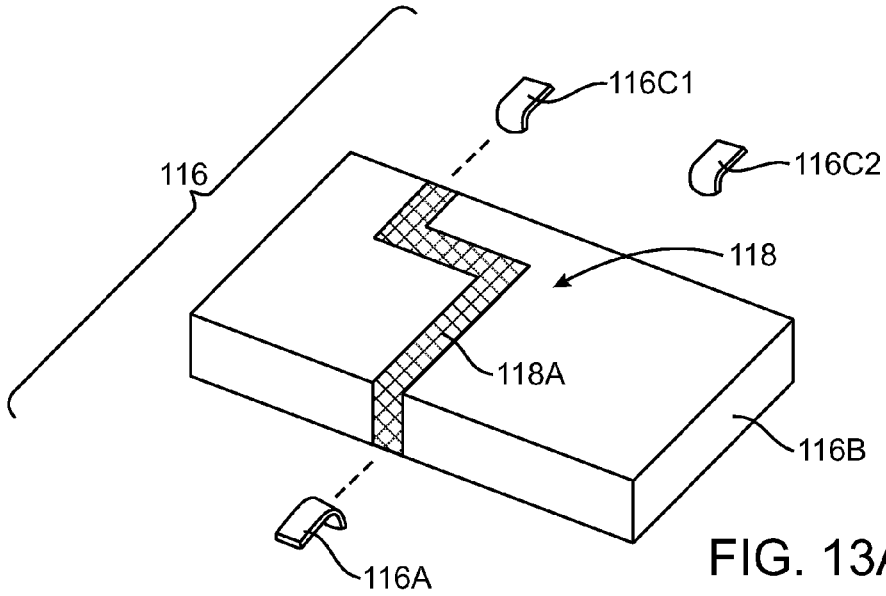
FIGS. 13A and 13B are diagrams showing how a path on a dielectric support structure such as a plastic support may be customized to form different antenna paths and thereby adjust antenna performance to compensate for manufacturing variations in accordance with an embodiment of the present invention.
Figure 13B:
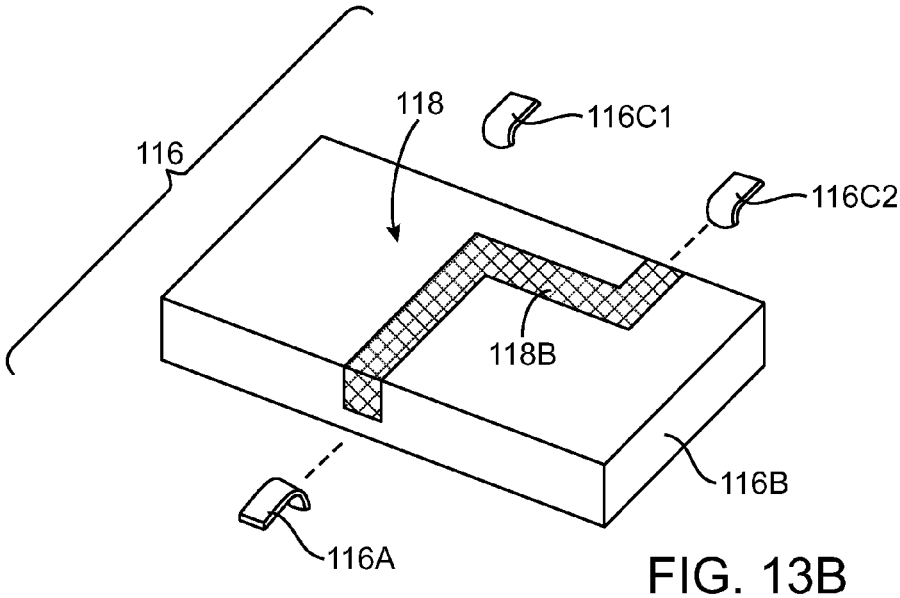

If desired, customized conductive paths within custom structures 116 may be formed on a plastic support or other dielectric support and springs may be used to form connections to the customized conductive paths. FIGS. 13A and 13B illustrate an illustrative arrangement of this type that may be used in implementing customized antenna support structures 116.

When custom structures 116 have the configuration shown in FIG. 13A, conductive path 118 will connect spring 116A to spring 116C1. Spring 116A may be connected to transmission line conductor 92A. Spring 116C1 may be connected to an antenna conductor such as conductive peripheral member 120 of FIG. 9 and may serve as antenna feed terminal 94 in antenna 40.

When custom structures 116 have the configuration shown in FIG. 13B, conductive path 118 will connect spring 116A to spring 116C2. Spring 116C2 may be connected to the antenna conductor (e.g., the conductive peripheral member 120 of FIG. 9) at a different location than spring 116C1 (i.e., at a location that allows spring 116C2 to serve as antenna feed terminal 94' in antenna 40).

Conductive paths such as path 118 on custom structures 116 of FIGS. 13A and 13B may be formed using a combination of fixed and customizable electrical structures. For example, fixed contacts may be formed that line up with springs 116A, 116C1, and 116C2. A portion of path 118 that runs between the fixed contact pads can be customized (e.g., using laser sensitization and selective metal deposition, using laser trimming, using screen printing, using pad printing, using spraying, etc.). Paths 118 with different shapes may also be formed using different shadow masks, photolithographic masks, by screen printing patterns, by spraying, by pad printing patterns, by stamping metal foil and attaching patterned foil to a support structure such as structure 116B with adhesive, etc.

Figure 14:
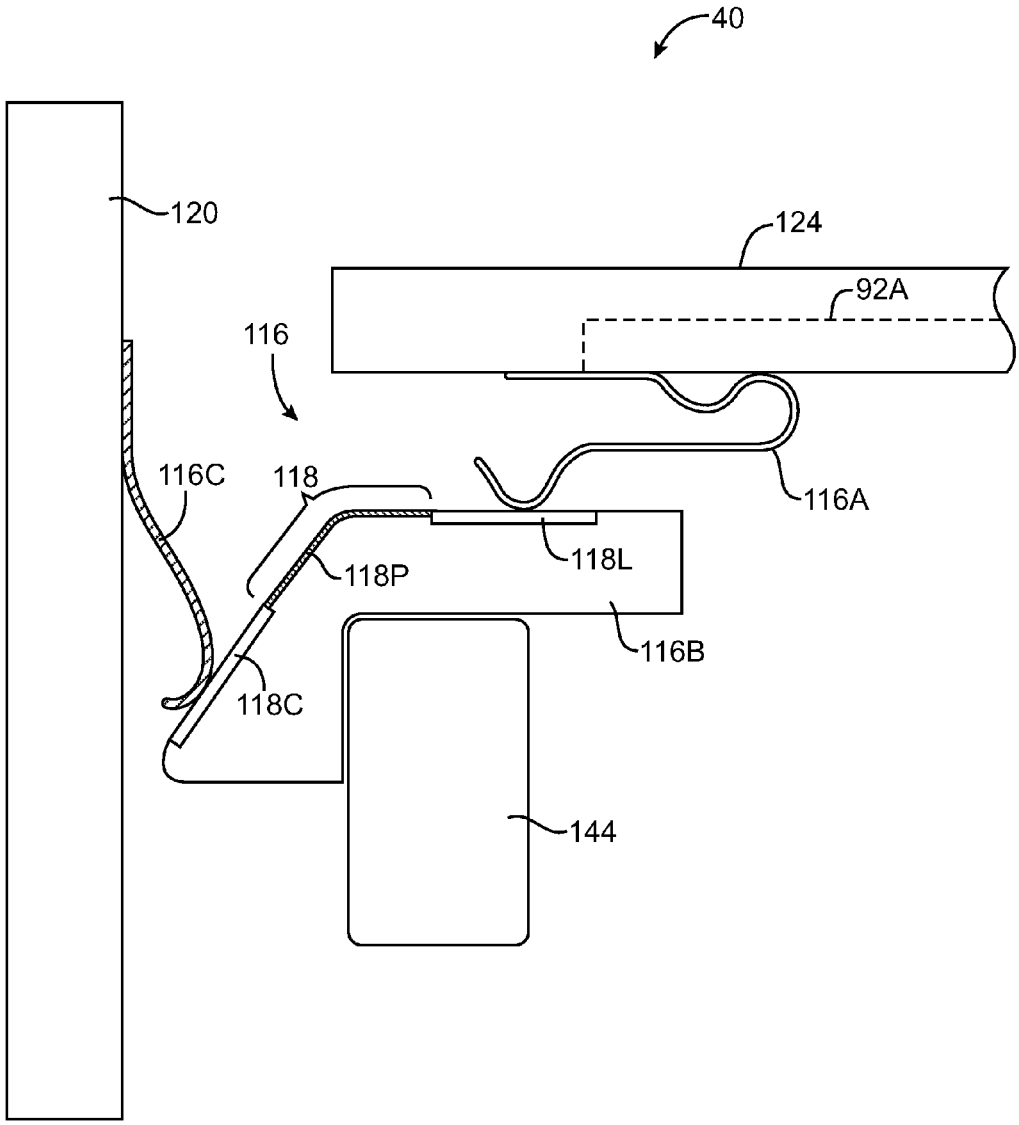
FIG. 14 is a cross-sectional side view of illustrative custom antenna connector structures including a plastic support with a customized conductive path and associated spring contacts that may be used in compensating for manufacturing variations in accordance with an embodiment of the present invention.

FIG. 14 is a cross-sectional side view of an illustrative arrangement that may be used for mounting custom structures such as custom structures 116 of FIGS. 13A and 13B into device 10. As shown in FIG. 14, support 116B may be provided with fixed contact regions such as pads 118L. Pads 118L form contact regions that may be interconnected using custom path 118P. If desired, path 118 may be formed as a customized unitary structure. Springs such as springs 116C and 116A may be used to form electrical connections with customized antenna structure 116. For example, spring 116C may used to connect peripheral conductive member 120 to one end of custom path 118 and spring 116A may be used to connect transmission line conductor 92A in printed circuit board 124 to the other end of custom path 118.

Support structure 116B may be formed from plastic or other suitable dielectric materials and may be mounted on a frame member or other support structure in device 10 (e.g., support structure 144). Support structure 144 may, for example, be a portion of a planar housing structure such as planer member 122 (FIG. 9).

Figure 15:
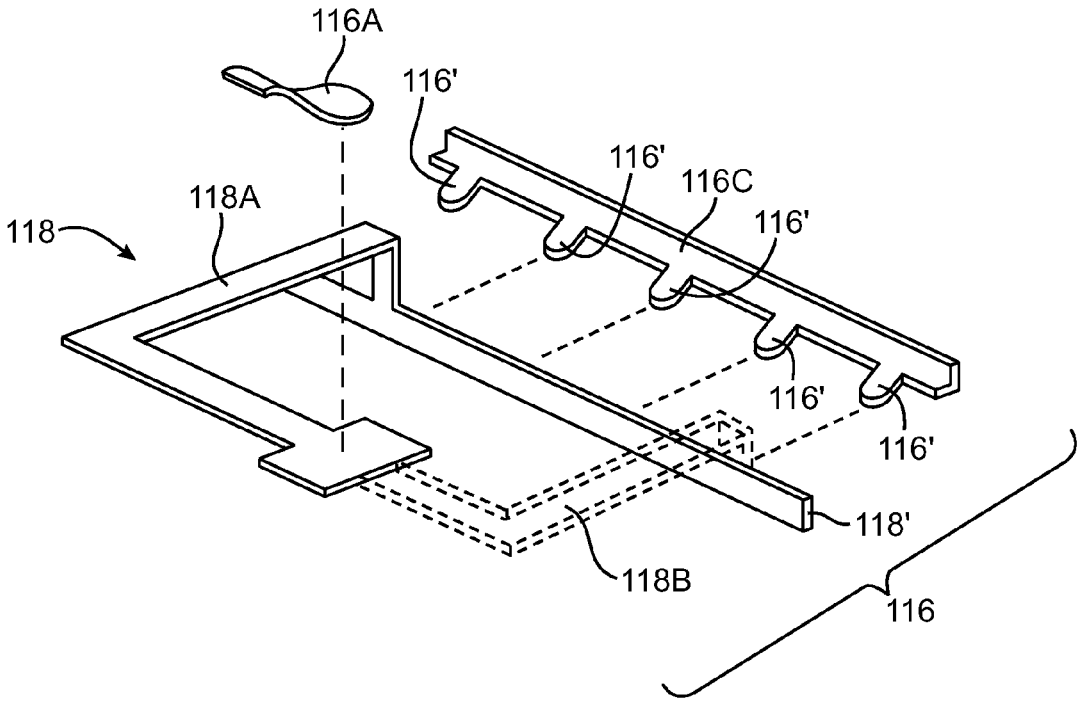
FIG. 15 is a perspective view of a custom antenna connector structure of the type shown in FIG. 14 with the plastic support removed to reveal how the conductive traces on the support may be patterned in various configurations in accordance with an embodiment of the present invention.

FIG. 15 is an exploded perspective view of illustrative custom antenna structures 116 that may be used in an arrangement of the type shown in FIG. 14. In FIG. 15, support structure 116B is not shown, so that path 118 is not obstructed in the drawing. As shown in FIG. 15, structures 116 may be customized so that path 118 either follows route 118A or route 118B between spring 116A and spring 116C. Spring 116A may be connected to transmission line path 92A and spring 116C may be connected to peripheral conductive member 120 (e.g., be forming laser welds with member 120 along the length of spring 116C). Spring 116C may have protruding portions 116' that mate with extended portion 118' of path 118.

Figure 16:
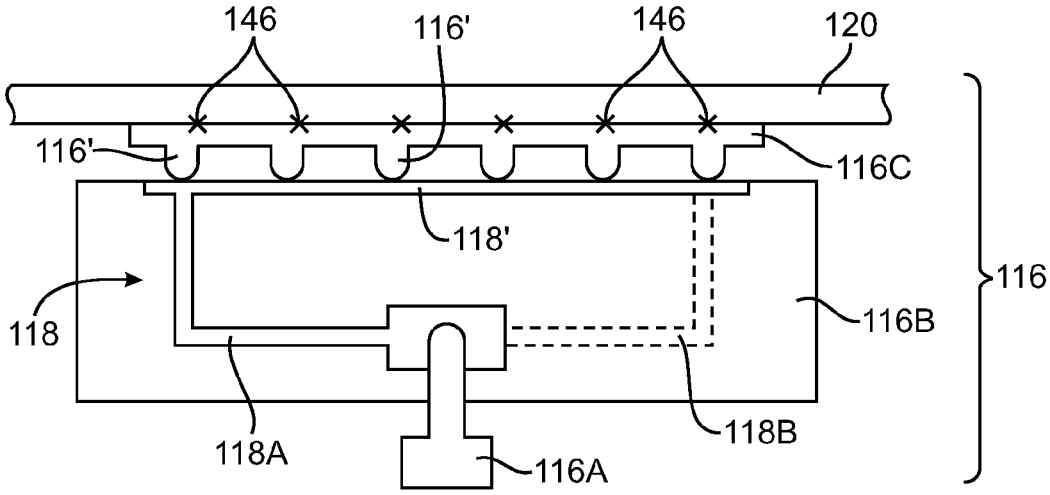
FIG. 16 is a top view of a custom antenna structure of the type shown in FIGS. 14 and 15 in accordance with an embodiment of the present invention.

FIG. 16 is a top view of the illustrative custom antenna structures 116 of FIG. 15 (with support member 116B present). FIG. 16 shows the possible location of laser welds 146 for forming connections along the length of spring 116C to peripheral conductive member 120.

Figure 17:
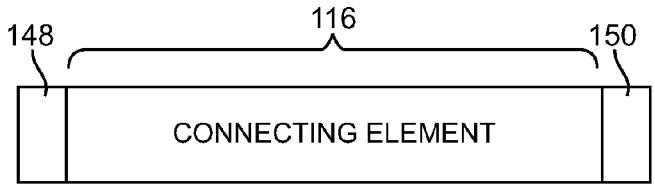
FIGS. 17, 18, and 19 are schematic diagrams showing how customizable antenna connector structures may be formed one, two, or three connecting elements in accordance with embodiments of the present invention.
Figure 18:
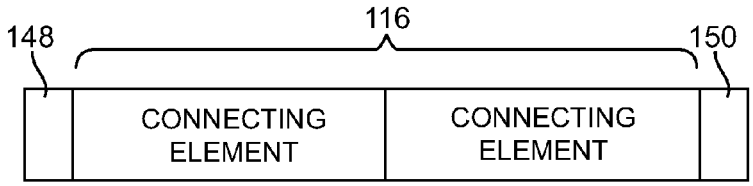
Figure 19:
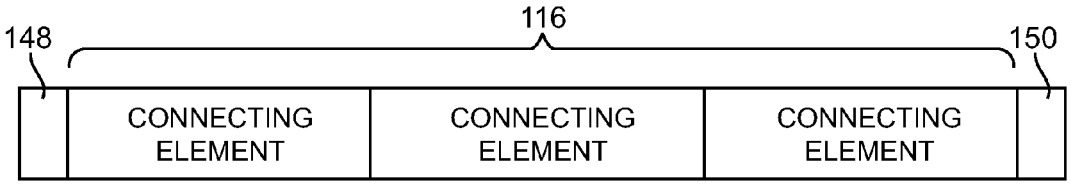

FIGS. 17, 18, and 19 are schematic diagrams of illustrative configurations that may be used in forming custom structures 116. As shown in FIGS. 17, 18, and 19, custom structures 116 may be used to couple conductive antenna structures 148 and 150 together in a customized way (e.g., with a customized length of connector structure 116 or with a custom shape that alters the conductive paths between and/or within structures 148 and 150). Structures 148 and 150 may be, for example, transmission line connector 92A and peripheral conductive member 120, parts of an antenna resonating element, parts of an antenna ground, antenna feed terminals, other antenna structures, or any combination of these structures.

In arrangements of the type shown in FIG. 17, custom structures 116 are formed from a single customized connecting element (e.g., a spring with a customizable shape). In arrangements of the type shown in FIG. 18, custom structures 116 include two connecting elements. One connecting element may be a spring and another connecting element may be a conductive structure supported on a dielectric member (as examples). One or both of the connecting elements in the FIG. 18 arrangement may be customized to alter path 118 (FIG. 8). In arrangements of the type shown in FIG. 19, custom antenna structures 116 may include three connecting elements. The first and third connecting elements may be, for example, springs, whereas the second connecting element may be a conductive path on a dielectric support. The shapes of the springs and/or the pattern formed by the conductive path in the second connecting element may be customized to customize path 118 (FIG. 8.).

Figure 20:
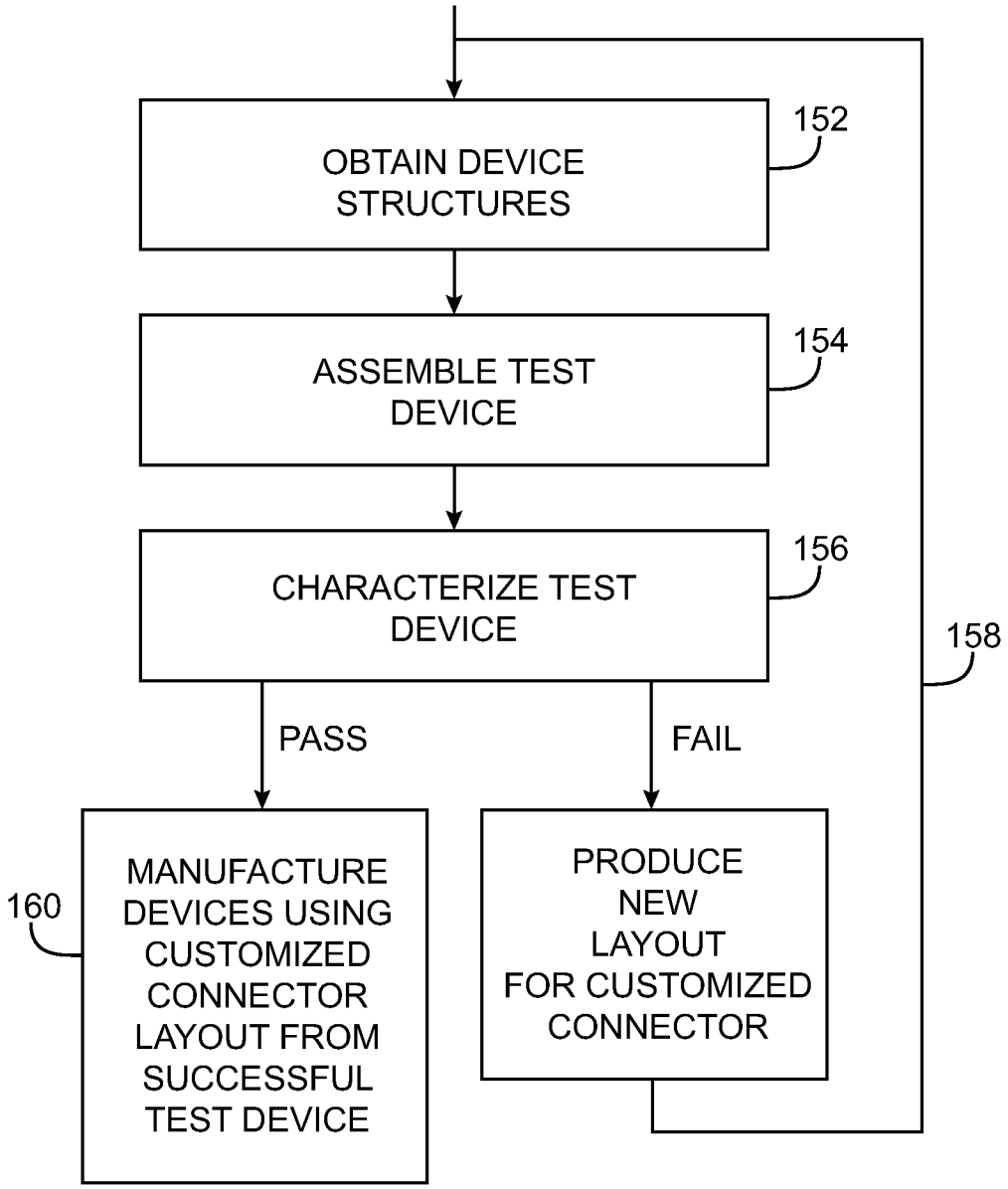
FIG. 20 is a flow chart of illustrative steps involved in characterizing antenna performance in electronic devices formed from a set of components and compensating for manufacturing variations by customizing antenna connector structures in accordance with an embodiment of the present invention.

FIG. 20 is a flow chart of illustrative steps involved in manufacturing devices that include custom antenna structures 116.

At step 152, parts for a particular design of device 10 may be manufactured and collected for assembly. Parts may be manufactured by numerous organizations, each of which may use different manufacturing processes. As a result, there may be manufacturing variations in the parts that can lead to undesirable variations in antenna performance if not corrected.

At step 154, a manufacturer of device 10 may assemble the collected parts to form one or more test versions of device 10. A typical manufacturing line may produce thousands or millions of nominally identical units of device 10. Production may take place in numerous batches. Batches may involve thousands of units or more that are assembled from comparable parts (i.e., parts made using identical or similar manufacturing processes). Batch-to-batch variability in antenna performance is therefore typically greater than antenna performance variability within a given batch.

After assembling a desired number of test devices at step 154 (e.g., one or more test devices representative of a batch of comparable devices), the test devices may be characterized at step 156. For example, the frequency response of the antenna in each of the test devices can be measured to determine whether there are frequency response curve shifts and other variations between devices (i.e., between batches).

When assembling test devices at step 154, custom antenna structures 116 or other such structures with a particular configuration (i.e., a particular configuration for path 118) may be used. If test results from the characterization operations of step 156 reveal that antenna performance is deviating from the desired nominal performance (i.e., if there is a frequency shift or other performance variation), appropriate custom antenna structures 116 may be installed in the test devices (i.e., structures with a different trial pattern for conductive path 118). As indicated by line 158, the custom antenna structures 116 and other device structures may be assembled to produce new versions of the test devices (step 154) and may be tested at step 156. If testing reveals that additional modifications are needed, different custom antenna structures 116 may again be identified and installed in the test device(s). Once testing at step 156 reveals that the test devices are performing satisfactorily with a given type of customized antenna structures 116, that same type of customized antenna structures 116 (i.e., structures with an identical pattern for conductor 118) may be selected for incorporation into production units.

With this approach, structures 116 with an appropriate custom pattern for line 118 or other custom configuration for the conductive portions of structures 116 may be identified from the test characterization measurements of step 156 and structures 116 with that selected configuration may be installed in numerous production devices during the production line manufacturing operations of step 160. In a typical scenario, once the proper customization needed for structures 116 within a given batch has been identified (i.e., once the proper customized antenna structures for compensating for manufacturing variations have been selected from a plurality of different possible customized antenna structures), all devices 10 within that batch may be manufactured using the same custom antenna structures 116.

Because the custom antenna structures were selected so as to compensate for manufacturing variations, the electronic devices produced at step 160 that include the custom antenna structures will perform as expected (i.e., the antenna frequency response curves for these manufactured devices will be accurate and will be properly compensated by the customized antenna structures for manufacturing variations). As each new batch is assembled, the customization process may be repeated to identify appropriate custom structures 116 for manufacturing that batch of devices. The custom antenna structures may have fixed (non-adjustable) configurations suitable for mass production. If desired, antennas 40 may also be provided with tunable structures (e.g., structures based on field-effect transistor switches and other switches) that may be controlled in real time by storage and processing circuitry 28.

The foregoing is merely illustrative of the principles of this invention and various modifications can be made by those skilled in the art without departing from the scope and spirit of the invention. The foregoing embodiments may be implemented individually or in any combination.

What is claimed is:

1. An electronic device, comprising:

an antenna having a conductive member;

a transceiver having an transmission line conductor; and custom antenna structures that compensate for manufacturing variations that affect antenna performance in the antenna, wherein the custom antenna structures include a customizable conductive path that connects the transmission line conductor to the conductive member at one of a plurality of custom locations.

2. The electronic device defined in claim 1 wherein the electronic device has a rectangular periphery and wherein the conductive member runs along the rectangular periphery.

3. An electronic device, comprising:

an antenna having a conductive member;

a transceiver having an transmission line conductor; and custom antenna structures that compensate for manufacturing variations that affect antenna performance in the antenna, wherein the custom antenna structures include a customizable conductive path that connects the transmission line conductor to the conductive member at a custom location, wherein the conductive member comprises a conductive peripheral member that forms at least some sidewall structures for the electronic device.

4. The electronic device defined in claim 3 wherein the custom antenna structures include a dielectric support on which at least part of the custom conductive path is formed.

5. The electronic device defined in claim 4 wherein the custom antenna structures comprise at least one spring associated with the custom conductive path.

6. The electronic device defined in claim 5 wherein the custom antenna structures comprise:

a first spring that is connected between the transmission line conductor and the custom conductive path; and a second spring that is connected between the custom conductive path and the conductive peripheral member.

7. The electronic device defined in claim 6 wherein the dielectric support comprises plastic on which a custom metal line is located that forms the customizable conductive path.

8. The electronic device defined in claim 7 further comprising first and second contact regions at opposing ends of the custom metal line, wherein the first contact region is connected to the first spring and wherein the second contact region is connected to the second spring.

9. An antenna, comprising:

conductive antenna structures; and custom antenna structures that are electrically connected to the conductive antenna structures and that have a fixed configuration that compensates for manufacturing variations in the conductive antenna structures, wherein the conductive antenna structures include a conductive electronic device housing member.

10. The antenna defined in claim 9 further comprising an antenna feed that is coupled between a transmission line and the conductive antenna structures, wherein the antenna feed includes at least one antenna feed terminal that is connected to a conductive line in the transmission line, and wherein the custom antenna structures are connected between the antenna feed terminal and the conductive electronic device housing member.

11. The antenna defined in claim 10 wherein the custom antenna structures comprise:

a first spring connected to the antenna feed terminal; and a second spring connected to the conductive electronic device housing member.

12. The antenna defined in claim 11 further comprising:

a dielectric member; and a conductive path on the dielectric member, wherein the conductive path is coupled between the first spring and the second spring.

13. An antenna, comprising:

conductive antenna structures; and custom antenna structures that are electrically connected to the conductive antenna structures and that have a fixed configuration that compensates for manufacturing variations in the conductive antenna structures, wherein the custom antenna structures comprise at least one spring and a dielectric support on which a customized metal conductor is formed.

14. The antenna defined in claim 9 wherein the custom antenna structures comprise:

first and second springs;

a dielectric member; and a conductive path on the dielectric member that connects the first and second springs, wherein at least one of the springs is connected to the conductive antenna structures.

15. A method for manufacturing a wireless electronic device, comprising:

forming conductive antenna structures; and forming custom antenna structures that are electrically coupled to the conductive antenna structures, wherein the custom antenna structures are selected from a plurality of different custom antenna structures, wherein each of the plurality of different custom antenna structures has a fixed configuration that compensates for manufacturing variations in the conductive antenna structures, and wherein each of the plurality of different custom antenna structures electrically couples to the conductive antenna structures at respective custom location.

16. The method defined in claim 15, wherein the wireless electronic device has a rectangular periphery, and wherein forming the conductive antenna structures comprises forming the conductive antenna structures at least partly from a conductive peripheral member that runs along the rectangular periphery.

17. The method defined in claim 16, further comprising:

forming an electrical connection between the conductive peripheral member and a transmission line conductor in the wireless electronic device.

18. The method defined in claim 17, wherein forming the custom antenna structures comprises forming a customized conductive path on a plastic support structure.

19. The method defined in claim 18, wherein the custom antenna structures include first and second springs, and wherein forming the custom antenna structures comprises mounting the plastic antenna support so that the first spring is interposed between the transmission line conductor and the customized conductive path and so that the second spring is interposed between the customized conductive path and the conductive peripheral member.

20. The method defined in claim 15, wherein forming the custom antenna structures comprises forming a customizable conductive path on a dielectric support, and wherein the conductive path couples a transmission line conductor associated with a transceiver in the wireless electronic device to the conductive antenna structures at a custom location.

* * * * *